US007312580B2

(12) United States Patent
Li et al.

(10) Patent No.: US 7,312,580 B2
(45) Date of Patent: Dec. 25, 2007

(54) SPACER MATERIAL FOR FLAT PANEL DISPLAYS

(75) Inventors: Hao Li, Chandler, AZ (US); Bernard F. Coll, Fountain Hills, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/288,499

(22) Filed: Nov. 28, 2005

(65) Prior Publication Data

US 2007/0120455 A1 May 31, 2007

(51) Int. Cl.
*G09G 3/10* (2006.01)

(52) U.S. Cl. ..... 315/169.1; 315/169.3

(58) Field of Classification Search ..... 313/292, 313/283, 495–497, 309, 336, 351; 315/169.1, 315/169.3

See application file for complete search history.

(56) References Cited

U.S. PATENT DOCUMENTS

| | | | | |
|---|---|---|---|---|
| 6,031,336 | A | 2/2000 | Rumbaugh et al. | |
| 6,075,323 | A * | 6/2000 | Smith et al. | 315/169.1 |
| 6,246,177 | B1 * | 6/2001 | Xie et al. | 315/169.1 |
| 6,791,255 | B1 * | 9/2004 | Derouin et al. | 313/495 |

* cited by examiner

*Primary Examiner*—Joseph Williams

(57) ABSTRACT

A spacer material is provided for a field emission display (10) with a cathode plate (12) having a plurality of electron emitters (44). An anode plate (14) is disposed to receive electrons emitted by the plurality of electron emitters (44), and includes an anode (26) designed to be connected to a potential source. A plurality of spacers (42) are positioned between the cathode plate (12) and the anode plate (14), the plurality of spacers (42) comprising a material that maintains a positive charge when the anode (26) is connected to the potential source.

15 Claims, 2 Drawing Sheets

SPACER MATERIAL FOR FLAT PANEL DISPLAYS

FIELD OF THE INVENTION

The present invention generally relates to flat panel displays and more particularly to a spacer material for flat panel displays.

BACKGROUND OF THE INVENTION

Several types of spacers for flat panel displays, such as field emission displays, are known in the art. A field emission display includes an envelope structure having an evacuated interspace region between two display plates. Electrons travel across the interspace from a cathode plate (also known as a cathode or a back plate), upon which electron emitting structures, such as Spindt tip or carbon nanotubes, are fabricated, on an anode plate (also known as an anode or face plate), which includes deposits of light emitting materials, or "phosphors". Typically, the pressure within the evacuated interspace region between the cathode and anode is on the order of $10^{-6}$ Torr.

The cathode and anode plates are thin in order to provide low display weight. If the display area is small, such as in a 1 inch diagonal display, and a typical sheet of glass having a thickness of 0.04 inch is utilized for the plates, the display will not collapse or bow significantly. However, if a larger display area is desired, the thin plates are not sufficient to withstand the pressure differential in order to prevent collapse of bowing upon evacuation of the interspace region. For example, a screen having a 30 inch diagonal will have several tons of atmospheric pressure exerted upon it. As a result of this tremendous pressure, spacers play an essential role in large area, light weight displays. Spacers are structures placed between the anode and cathode plates for keeping them a constant distance apart. The spacers, in conjunction with the thin, light weight plates, counteract the atmospheric pressure, allowing the display area to be increased with little or no increase in plate thickness.

Several schemes have been proposed for providing spacers. Some of these schemes include the affixing of spacer (structural members such as glass rods) to the inner surface of one of the display plates. In one such prior art scheme, glass rods are affixed to one of the display plates by applying devitrifyng solder glass frit to one end of the rod or post and bonding the frit to the inner surface of one of the display plates. Another known method uses thermocompression bonding to smash one layer of metal into another layer of metal. The bond that is created is strong enough to permit handling and sealing of the device components.

During operation of a flat panel display, as electrons are emitted toward an anode from the electron emitters, some of the electrons will strike the spacers, resulting in secondary electron emission from the spacers. The secondary electron emissions cause the spacers to have a positive charge (more electrons are departing the spacer than are impacting the spacer), thereby attracting (changing the trajectories) more of the primary electrons. These electrons departing the spacer are prevented from striking the intended pixel causing it to be darker (less than the desired number of electrons) and strike the anode area adjacent to the spacer causing an undesired illuminated area typically shaped as a white line, for example.

It has been shown that directing electrons at the spacers when the anode voltage is substantially reduced can neutralize the charge by adding electrons to the spacer. However, spacers in conventional flat panel displays comprise materials that limit the upper voltage on the anode. At higher anode voltages, e.g., above 5,000 volts to 10,000 volts, the spacers become negatively charged and this neutralizing method does not work.

Accordingly, it is desirable to provide a spacer material for flat panel displays having a high anode voltage. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A spacer material is provided for a field emission display. The field emission display comprises a cathode plate having a plurality of electron emitters. An anode plate is disposed to receive electrons emitted by the plurality of electron emitters, and includes an anode designed to be connected to a potential source. A plurality of spacers are positioned between the cathode plate and the anode plate, the plurality of spacers comprising a material that maintains a positive charge when the anode is connected to the potential source.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Conventional flat panel displays have utilized a material for the spacers that limit the anode-cathode operating voltage due to the spacer becoming negatively charged at higher voltages due to being struck by electrons from the emitters during normal operation. Materials have been identified that will allow flat panels to operate at higher voltages, e.g., between 5,000 to 15,000 volts, or higher, while maintaining a minimal positive charge. This charge may then be neutralized using conventional means by adding electrons from the emitters to the spacers while the anode-cathode voltage is substantially reduced.

Figure 1:
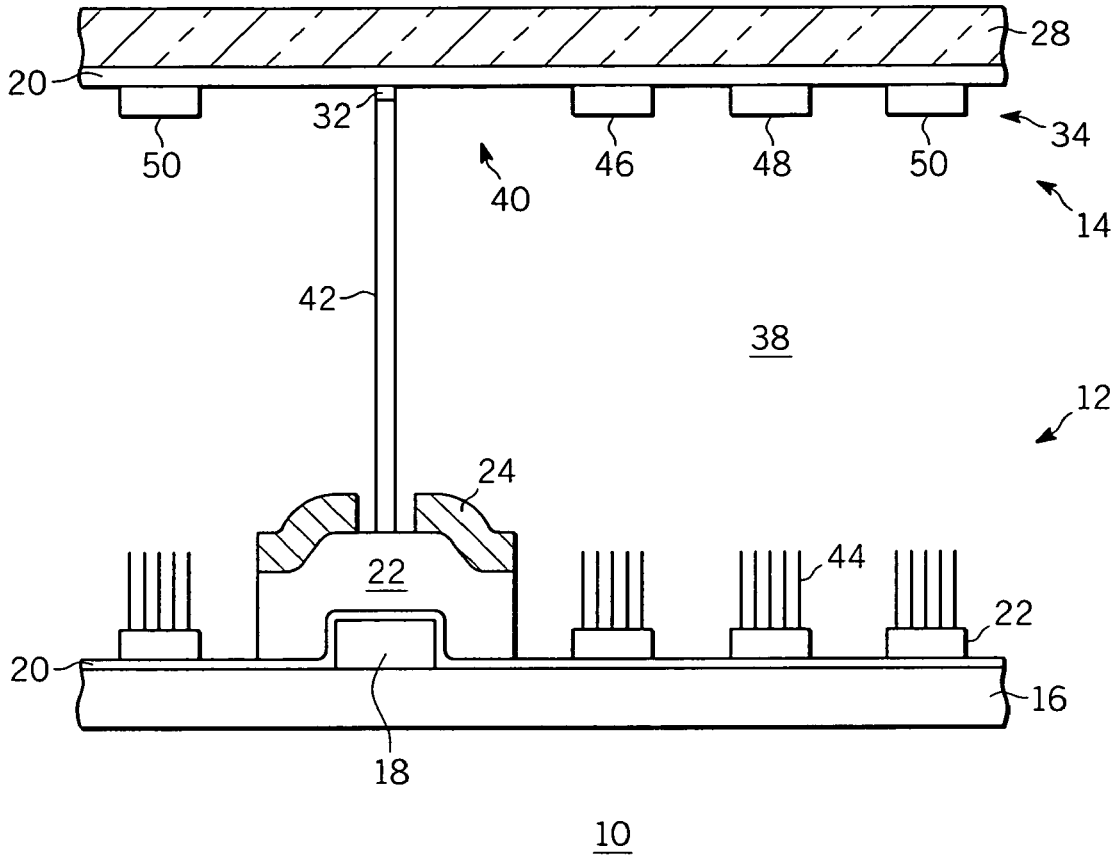
FIG. 1 is a partial cross section of an exemplary embodiment of the present invention.

Referring to FIG. 1, a previously known process for forming a cathode 12 and anode 14 of a field emission display device 10, which may be used with the present invention, includes depositing a cathode metal 18 on a substrate 16. The substrate 16 comprises silicon; however, alternate materials, for example glass, ceramic, metal, a semiconductor material, an organic material, or a combination thereof are anticipated by this disclosure. Substrate 16 can include control electronics or other circuitry, which are not shown in this embodiment for simplicity. The cathode metal 18 may comprise any conductive layer, for example, a chrome/copper/chrome layer. An optional ballast resistor layer 20 of a semiconductor material is deposited over the cathode metal 18 and the substrate 16. A dielectric layer 22 is deposited over the ballast resistor 20 above the cathode metal 18 to provide spacing for the gate electrode 24. The gate electrode 24 comprises a metal, preferably molybdenum. The above layers and materials are formed by standard lithographic techniques known in the industry.

A catalyst is formed on the ballast resistor 20, or in contact with the cathode 18 if the ballast resistor is not used. The catalyst 22 preferably comprises nickel, but could comprise any one of a number of other materials including cobalt, iron, and a transition metal or oxides and alloys thereof. The catalyst 22 may be formed by any process known in the industry, e.g., co-evaporation, co-sputtering, co-precipitation, wet chemical impregnation, adsorption, ion exchange in aqueous medium or solid state. One or more ancillary layers (not shown) for altering physical properties of the catalyst 22 optionally may be formed on the ballast resistor layer 20 and gate electrode 24 prior to forming the catalyst 22.

The anode 14 comprises a transparent plate 28, which is typically made of glass. A plurality of pixels 34 arranged typically in rows and columns across the anode 14 include deposits of a light emitting material, such as a cathodoluminescent material, or phosphor. A plurality of regions 40 exist between the rows and/or columns for making physical contact with spacers 42 so that a predetermined spacing can be maintained between the anode 14 and the cathode 12, without interfering with the light emitting function of the display 10 and thereby defining an evacuation area 38. The spacers 42 comprise a rigid material that is able to withstand intense pressure exerted by the anode 14 and cathode 12.

A black surround layer (black matrix) 26, for example ruthenium oxide, is formed on a transparent plate 28 of anode plate 14. The black surround layer 26 may comprise a thickness in the range of 1-20 μm, and more preferably is 5 μm. A ductile metal layer 32, preferably formed of silver, is applied on the black matrix 26 and adheres thereto. In the preferred embodiment, these layers are deposited with thick film techniques such as screen printing, electrophoretic deposition, or electroplating rather than thin film vacuum deposition techniques. The layer 28 may comprise a thickness in the range of 0.1-5 μm, and more preferably is 3 μm. These two layers may be formed across the transparent plate 28 and then screen printed to form the desired locations. For anodes built with the Fodel (photodefinable screen print paste) technology, the silver fodel and the black matrix can be deposited in sequential steps and then exposed with the same photomask. Light emitting material 18 is placed as pixels 34 by screen printing.

The phosphor-coated anode 14 described above presents the light emitting material to the direct impact of electrons. High voltage display designs benefit from providing a thin aluminum layer (not shown) over the light emitting material.

Electron emitting structures (not shown), such as Spindt tips (not shown) or carbon nanotubes 44, are positioned on the catalyst 22 for directing electrons at and illuminating the light emitting material 34 positioned on the anode 14 as is well known in the industry. Each pixel of the plurality of pixels 34 is divided into three subpixels 46, 48, 50. Each subpixel 46, 48, 50 is formed by a phosphor corresponding to a different one of the three primary colors, for example, red, green, and blue. Correspondingly, the electron emission sites on the cathode 12 are grouped into pixels and subpixels, where each emitter subpixel is aligned with a red, green, or blue subpixel 46, 48, 50 on the anode 14. By individually activating each subpixel 46, 48, 50, the resulting color can be varied anywhere within the color gamut triangle. The color gamut triangle is a standardized triangular-shaped chart used in the color display industry. The color gamut triangle is defined by each individual phosphor's color coordinates, and shows the color obtained by activating each primary color to a given output intensity.

The spacers 42 are placed on the cathode 12 and anode 14 by one of a number of standard metal to metal bonding techniques, such as thermocompression bonding, thermosonics bonding, ultrasonic bonding and the like. In this particular embodiment, a thermocompression method is used to contact the silver layer 28. Mechanical deformation aids the bonding. The bonding is performed at elevated temperatures from 50-500 degrees, preferably at 250 degrees Celsius. A bonding force between 100 to 10000 grams is then applied to the spacer.

In accordance with an exemplary embodiment of the present invention, the spacers 42 comprise a material having an energy crossover point (as explained below) that maintains a positive charge on the spacers and that is preferably close to neutral in a high anode to cathode voltage (working voltage) up to 15,000 volts. Examples of this material include magnesium oxide (MgO) or aluminum oxide ($Al_2O_3$).

Figure 2:
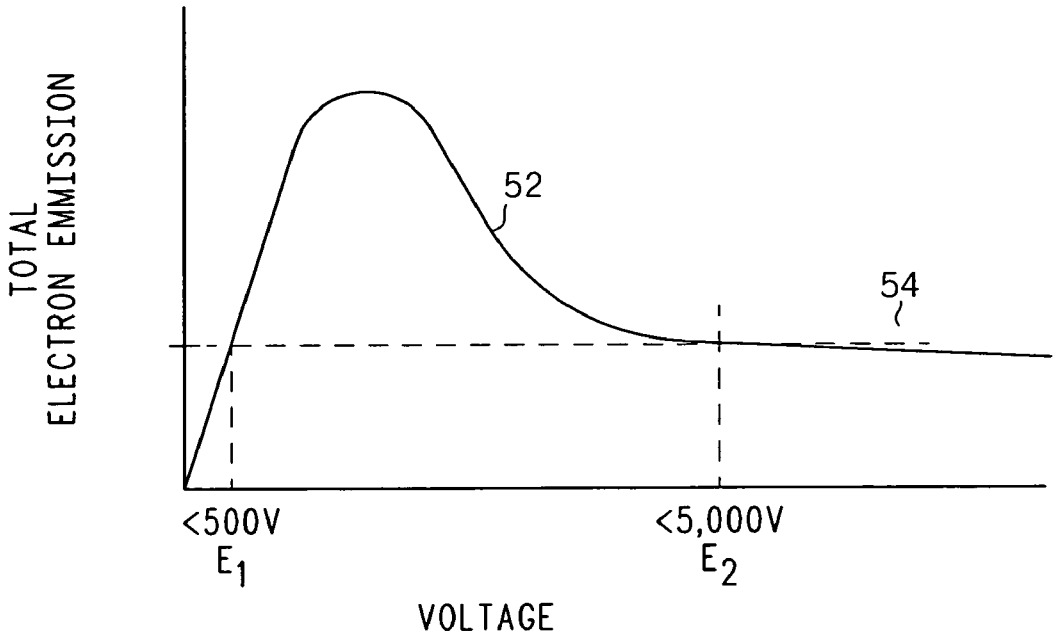
FIG. 2 is a graph representing electron emission versus voltage for materials previously used in field emission displays.

Referring to FIG. 2, a curve of total electron emission versus voltage is shown for materials typically used in previously known field emission displays. Typical materials would include glass and silicon dioxide, or $BaNdTiO_3$, for example. The curve 52 represents the electron emission from a spacer when struck by electrons from the electron emitters 44. The total electron emission includes both the backscattered electrons (from emitters 44) and the secondary electrons. When the curve 52 is above one (shown as the horizontal dotted line 54), the number of electrons leaving the spacer surface at this corresponding voltage range is higher than that of the number of electrons initially striking the spacer, resulting in a positive charge on the spacer surface. When the curve 52 is below the horizontal dotted line 54, the charge on the spacers is negative. E1 and E2 represent points on the curve 52 where there is no net gain or loss of electrons by the spacer (the charge is neutral). Field emission displays have typically used anode voltages of less than 5,000 volts, resulting in a positive charge on the spacers. The positive charge may be removed from the spacers by lowering the anode voltage to ground and impacting electrons from the electron emitters onto the spacers at a low velocity. The electrons remain on, or in, the spacer, thereby reducing the positive charge.

The operation of the field emission device 10 includes a scanning mode and a discharge mode (comprising a frame). During the scanning mode, potentials are sequentially applied to rows of the electron emitters 44. Scanning means that a potential suitable for causing electron emission is selectively applied to a scanned row. Whether each of electron emitters 44 within a scanned row is caused to emit electrons depends on the video data and the voltage applied to each column. Electron emitters 44 in the rows not being scanned are not caused to emit electrons. During the time that one of the conductive rows is scanned, potentials are applied to conductive columns according to video data.

During the scanning mode, an anode voltage (potential at the anode 14), is selected to attract electrons from the electron emitters 44 toward the anode plate 14 and to provide the desired level of brightness of the image generated by the phosphors. During the scanning mode, most of the electrons emitted by electron emitters 44 strike the anode plate 14. However, some of the emitted electrons and backscattered electrons from the anode impinge upon the spacers 42, causing them to become positively electrostatically charged. The charged surfaces cause undesirable effects, such as adversely affecting the control of the electrons from the electron emitters 44.

To achieve the discharge mode of operation, the anode voltage is reduced to a lower voltage, which may be as low as several hundred volts to ground potential. After the anode voltage is lowered, the gate/row voltage is turned high to extract electrons from the emitters. These electrons are attracted by the positive surface charging on the spacer surface and they neutralize the positively charged spacers 42 by "adding" electrons to the spacer.

However, field emission displays more recently have been using higher anode voltages of between 5,000 and 15,000 volts, for example. Using the material previously used for the spacers 42 results in a negative charge on the spacers 42 as seen from FIG. 2 for the curve 52 beyond E2. This negative charge deflects the electrons emitted from the electron emitters 44 away from their intended pixel 34, resulting in visible spacers. In addition, it also deflects the low energy electron extracted during the discharge mode away from the spacer, rendering discharge ineffective. This leads to negatively charged spacers being visible and remaining visible even with the discharge process.

Figure 3:
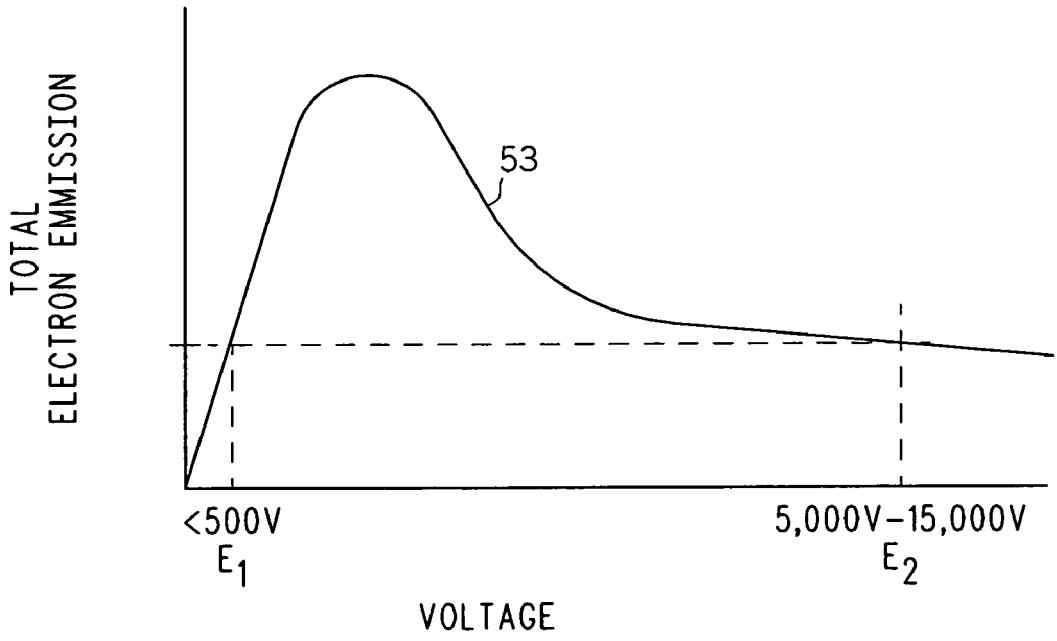
FIG. 3 is a graph representing electron emission versus voltage for an exemplary embodiment of the present invention.

Referring to FIG. 3, and in accordance with the present invention, by selecting a material having a cross over point E2 (on curve 53) at a high voltage (shown as about 15,000 volts), the spacers would maintain a positive charge. This high voltage at which the spacers would maintain a positive charge would be slightly greater than the working voltage (the anode to cathode voltage). Preferably, the charge would only be slightly positive (voltage is just less than the cross over point). Examples of this material include magnesium oxide (MgO) and aluminum oxide ($Al_2O_3$).

The discharging process described above may then be used to neutralize the small positive charge on the spacers.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A method of reducing charge accumulation in a field emission display including a cathode plate having a plurality of electron emitters, an anode plate disposed to receive electrons emitted by the plurality of electron emitters, and a plurality of spacers positioned between the cathode plate and the anode plate, the method comprising:

during a scanning mode:

applying an anode voltage in the range of 5,000 to 15,000 volts to the anode plate for attracting electrons from the electron emitters; and maintaining a positive charge on the plurality of spacers comprising a material that maintains a positive charge by having a total electron emission coefficient higher than one at the anode voltage in the range of 5,000 to 15,000 volts, where one or more electrons depart each spacer for each electron striking the spacer; and during a discharge mode:

reducing the anode voltage; and extracting electrons from the plurality of electron emitters to strike the plurality of spacers; and thereby neutralizing the positive charge on the plurality of spacers.

2. The method of claim 1 wherein the maintaining a positive charge comprises maintaining a positive charge on a material comprising one of magnesium oxide, aluminum oxide, or a combination thereof.

3. The method of claim 1 wherein the maintaining a positive charge comprises maintaining a positive charge on a material selected from one of the group consisting of magnesium oxide, aluminum oxide, or a combination thereof.

4. The method of claim 1 wherein the applying an anode voltage comprises applying a voltage in a range of 10,000 to 15,000 volts.

5. The method of claim 1 wherein the field emission display further includes a gate disposed between the anode plate and the plurality of electron emitters and the method further comprises applying a gate voltage to the gate during the scanning mode and increasing the gate voltage during the discharge mode.

6. A method of reducing charge accumulation in a field emission display including a cathode plate having a plurality of electron emitters, an anode plate disposed to receive electrons emitted by the plurality of electron emitters, and a plurality of spacers positioned between the cathode plate and the anode plate, the method comprising:

during a scanning mode:

applying an anode voltage in the range of 5,000 to 15,000 volts to the anode plate for attracting electrons from the electron emitters during;

preventing a negative charge on the plurality of spacers comprising a material having a crossover point in the range of 5,000 to 15,000 volts where one or more electrons depart each spacer for each electron striking the spacer; and during a discharge mode:

reducing the anode voltage; and causing the electrons to strike the plurality of spacers; and neutralizing a positive charge on the plurality of spacers.

7. The method of claim 6 wherein the preventing a negative charge comprises preventing a negative charge on a material comprising one of magnesium oxide, aluminum oxide, or a combination thereof.

8. The method of claim 6 wherein the preventing a negative charge comprises preventing a negative charge on a material selected from one of the group consisting of magnesium oxide, aluminum oxide, or a combination thereof.

9. The method according to claim 6 wherein the applying an anode voltage comprises applying an anode voltage in a range of 10,000 to 15,000 volts.

10. The method according to claim 6 wherein the field emission display further includes a gate disposed between the anode plate and the plurality of electron emitters and the method further comprises applying a gate voltage to the gate during the scanning mode and increasing the gate voltage during the discharge mode.

11. A method for reducing charge accumulation in a field emission display comprising:

providing a first controllable positive potential within the field emission display;

providing a positively electrostatically charged surface within the field emission display;

providing a second controllable positive potential to cause electron emitters within the field emission display to emit electrons; and adjusting the first controllable positive potential to cause electrons to be received by the positively electrostatically charged surface that maintains a positive charge by having a crossover point in the range of 5,000 to 15,000 volts where one or fewer electrons depart each positively electrostatically charged surface for each electron striking the positively electrostatically charged surface, thereby causing neutralization of the positively electrostatically charged surface.

12. The method of claim 11 wherein the providing a positively electrostatically charge comprises providing a positively electrostatically charge on a material comprising one of magnesium oxide, aluminum oxide or a combination thereof.

13. The method of claim 11 wherein the providing a positively electrostatically charge comprises providing a positively electrostatically charge on a material selected from one of the group consisting of magnesium oxide, aluminum oxide, or a combination thereof.

14. The method of claim 11 wherein the providing a positively electrostatically charge comprises providing a positively electrostatically charge on a material selected from one of the group consisting of magnesium oxide, aluminum oxide, or a combination thereof.

15. The method according to claim 11 wherein the applying an anode voltage comprises applying a voltage in a range of 5,000 to 15,000 volts.

* * * * *